United States Patent [19]

Boughton

[11] Patent Number: 4,639,723

[45] Date of Patent: Jan. 27, 1987

[54] DATA DISPLAY SYSTEM

[75] Inventor: Geoffrey J. Boughton, Sandy, England

[73] Assignee: International Computers Limited, London, England

[21] Appl. No.: 613,523

[22] Filed: May 24, 1984

[30] Foreign Application Priority Data

Jun. 8, 1983 [GB] United Kingdom ..... 8315752

[51] Int. Cl.[4] ..... G09G 1/02

[52] U.S. Cl. ..... 340/799; 340/311.1; 340/825.44

[58] Field of Search ..... 340/718, 724, 711, 755, 340/790, 792, 799, 721, 825.19, 825.44, 311.1; 233/61 PB, 61 PK; 364/706

[56] References Cited

U.S. PATENT DOCUMENTS

| | | | |
|---|---|---|---|
| 3,976,995 | 8/1976 | Sebestyen | 340/792 X |
| 4,139,893 | 2/1979 | Poland | 364/706 |
| 4,293,855 | 10/1981 | Perkins | 340/825.19 X |
| 4,323,896 | 4/1982 | Fiedler et al. | 340/792 X |
| 4,360,806 | 11/1982 | von Krome et al. | 340/792 |
| 4,412,217 | 10/1983 | Willard et al. | 340/825.44 |
| 4,438,433 | 3/1984 | Smoot et al. | 340/825.44 |
| 4,458,238 | 7/1984 | Learn | 340/711 X |
| 4,473,824 | 9/1984 | Clayton | 340/792 X |
| 4,503,428 | 3/1985 | Hashimoto et al. | 340/792 |
| 4,530,068 | 7/1985 | Nakanishi et al. | 364/706 X |

*Primary Examiner*—Gerald L. Brigance
*Assistant Examiner*—Vincent P. Kovalick
*Attorney, Agent, or Firm*—Lee, Smith & Zickert

[57] ABSTRACT

A visual display system having a restricted data display capability incorporating a main buffer store (1) having a storage capacity for data lines greater than the display line capacity of the display (2). Status information signals from a control unit 14 are associated with each line of data as it is introduced into the display so that when the display is scrolled or racked to free data display lines for new data—the status signal effectively decides whether a line of data is discarded or fed into the main buffer store (1).

4 Claims, 12 Drawing Figures

DATA DISPLAY SYSTEM

BACKGROUND OF THE INVENTION

This invention relates to display systems and more particularly to restricted area display units such as hand holdable data terminals.

In a known terminal, having a display area capable of accepting a particular maximum number of lines of data, the lines of data to be displayed are placed upon the screen in consecutive fashion until the total line availability of the display screen has been filled. After this condition has been attained it is necessary to provide some form of control—commonly called rackup for shifting the display with respect to the screen, conventionally in an upward direction, line-by-line so as to make available line space for receiving and displaying further lines of data. It is desirable that the lines of data racked out of display view be stored so as to allow for the return of previously displayed lines to the viewable display area. This requirement becomes more pressing particularly with hand held interactive terminals, according to the degree by which the amount of data in use exceeds the display capacity and is satisfied by providing a screen buffer with a capacity larger than the display screen capacity. Bearing in mind that it is desirable for a hand held interactive terminal having a display of the order of four lines to be able to imitate as far as possible conventionally sized display screens it is important that such a screen buffer is provided which is able to accommodate at least the maximum number of lines likely to be expected by an application of the display. For example, an overall area equivalent to the line possibility of an A4 sheet—that is some sixty four possible data lines. Again, bearing in mind that a hand holdable terminal can often display up to four lines only, it is necessary that the screen buffer should be able to accommodate scroll-back of all lines which have been racked out of sight but which still remain within the above mentioned A4 screen size. Furthermore, since a hand held terminal is frequently used off line in the manner of a note pad, (in that data is entered which it is desired to retain for periods which may overlap, partially or entirely a line activity) it is clearly desirable to be able readily to remove from the screen buffer any trivial data or transient data it is not necessary to retain.

SUMMARIES OF THE INVENTION

Broadly, according to a first aspect of the invention there is provided a method of recording data in a terminal, having a restricted capacity for visably displaying lines of data, on a screen, by which, associated with entry of data into the terminal, a decision to retain or discard data entered may be signalled to the terminal, and whereby stored data associated with such signals is selectively flagged to be subsequently retained or deleted as it is racked off the visible screen.

According to a second aspect of the invention there is provided a visual display system having restricted data display capability including; means providing a visual display having a predetermined display data line capacity; a main buffer store having a data line storage capacity greater than the capacity of the visual display; means for enabling the content of the visual display to be entered into the main buffer store as additional data lines of data are introduced into the visual display and during racking or scrolling of data lines being displayed out of the display area; means for enabling establishment, on entry of a data line into the visual display for each or selected ones of the data lines, a status information signal; and means for selectively causing the status information signals to act upon the associated display data lines during the racking or scrolling operation with a view to retaining or discarding the content of a data display line as required, whereby the buffer store receives only data to be retained.

BRIEF DESCRIPTION OF THE DRAWINGS

For a better understanding of the invention a schematically represented system incorporating the invention will be discussed in greater detail in relation to the accompanying drawings in which.

DESCRIPTION OF THE PREFERRED EMBODIMENT OF THE INVENTION

Figure 1:
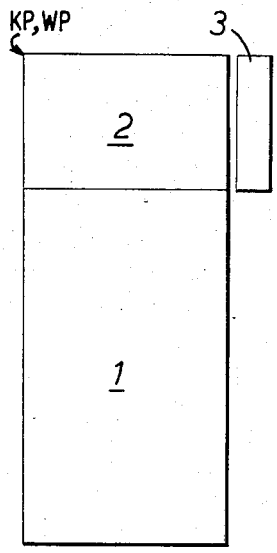
FIG. 1(1) to FIG. 1(10) schematically illustrate a sequence of events in the introduction; deletion, and retention of data applied to a hand holdable terminal.
Figure 1:
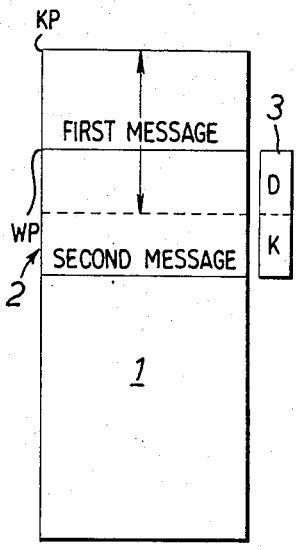
Figure 1:
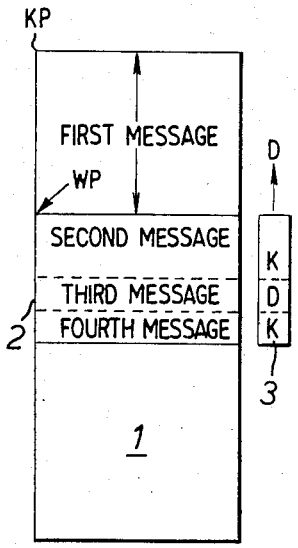
Figure 1:
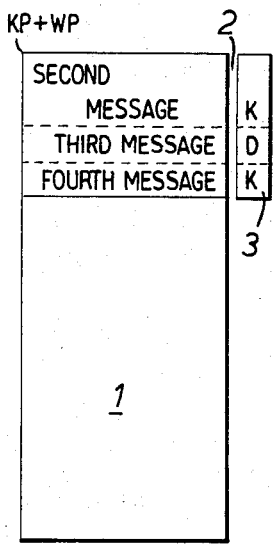
Figure 1:
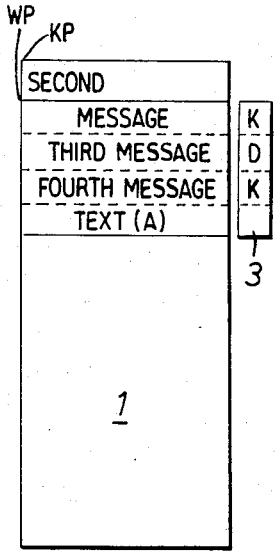
Figure 1:
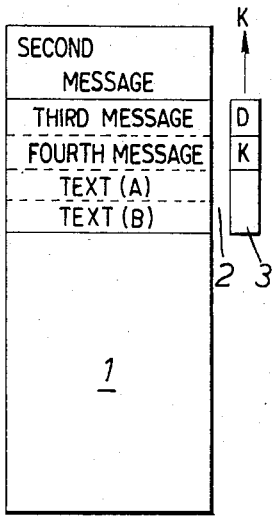
Figure 1:
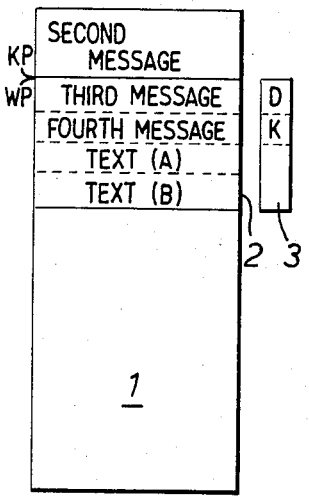
Figure 1:
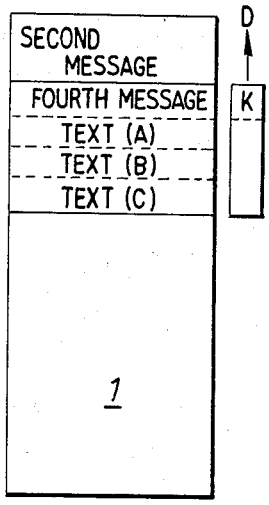
Figure 1:
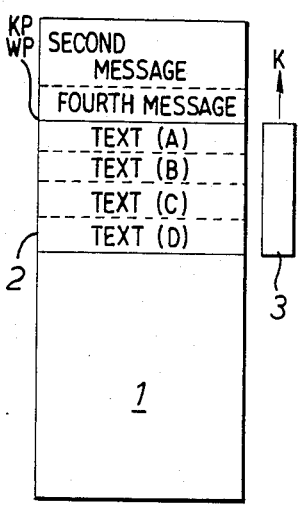
Figure 1:
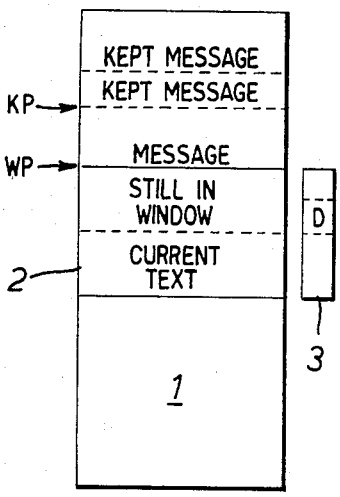

Referring now to FIGS. 1(1) to 1(10) these schematically depict the screen buffer store 1 of a hand holdable terminal having a local keyboard (not shown) and having a display area or window 2. Adjacent to the buffer 1 there is depicted a relatively small rectangle 3 which is intended to provide for the purposes of this description a visual indication of the instantaneous status of the storage control arrangements involved in the utilisation of the buffer 1 and can conveniently be regarded as a flag buffer. This flag buffer 3 provides a storage space which maps the four successive lines of the buffer—corresponding to the display area or window 2.

As has been previously indicated it is desired to be able selectively to retain or discard data such as alpha/-numerical data entered into screen buffer either from a local keyboard or from a host processor (not shown). In the following discussion a screen buffer store location coinciding with the end of a passage to be retained will be called a keep point and denoted by the letter KP; whilst the start of such passage will be denoted by K. An indication of a discard or deletion from the screen buffer store will be indicated by a letter 'D', and the uppermost screen buffer storage line corresponding to the upper boundary of the screen buffer display area will be identified as WP (Window Point).

Referring now to FIG. 1(1) it will be noted that this represents an initial state in which the screen buffer is empty and the display window 2 is blank.

The window 2 occupies four lines of buffer so that the window point (WP) and keep point (KP) locations are at the uppermost part of the FIG. 1(1).

FIG. 1(2) illustrates the situation in which two messages have been entered into the screen buffer store 1. Of these the first requires for example, five lines of the buffer storage facility and the second, two lines of the storage facility. As depicted, it is not desired to retain the first message but it is required to retain the second message. Thus the flag buffer 3 will store the delete flag D and keep flag K in the locations as shown, the positions of the flags D and K being equivalent to the location of the last line of the associated message.

The FIG. 1(3) represents the situation when two further messages have been entered. Each message, in so far as FIG. 1(3) is concerned, comprising a single line of the screen buffer store. The buffer store flag 3 shows that it is not desired to retain the third message and that it is intended to keep the fourth message i.e. the flag buffer 3 will store the flags K,D,K as shown.

It will also be noted that the first message has been racked out from the display area, (for convenience of representation the display area has been lowered) and that the remaining messages 2,3 and 4 are illustrated as being contained in the display area. Since it is not required to retain the first message, as is shown by the associated flag buffer, a discard indicator is called for and the discard operation is represented by the discard flag D being racked out of the buffer 3.

Because of the ejection of the discard flag D from the flag buffer 3 the first message is erased or overwritten by the data below the new WP by means of a block move procedure so that the display window area effectively returns the starting position as shown in FIG. 1(4). As further data is entered into the terminal the display window 3 commences effectively to move down the screen buffer store as is shown in FIG. 1(5). Since it is desired to retain the second message the entering of the new data is into fresh screen buffer store space so that for presentation purposes the window area is shown as moving downwards in the FIG. 1(5). It will thus be noted in FIG. 1(5) that the keep point KP is at the top line of the screen buffer store and the window pointer WP is located one buffer row downwardly thereof.

It will likewise be observed that the flag buffer 3 has a K in the uppermost slot.

As further data is entered into the screen buffer store the second message is effectively racked-up out from the display area 2. At the point where this second message moves out of the display area a keep flag K is "ejected" from the flag buffer 3—thereby indicating retention of the second message. This particular situation is shown in FIG. 1(6) in which the flag buffer 3 now contains K and D.

The keep pointer KP is then set to the end of message 2 and as is shown in FIG. 1(7) the window point WP moves down as with normal rack-up to the start of the line below that containing the end of the second message.

It will additionally be noted that the upper line of the third message is located at the uppermost position in the window 2. Since the intention is to discard or delete the third message and to keep the fourth message the keep flag K is inserted at the line corresponding to the end of the fourth message and the requisite delete flag D is inserted in the flag buffer 3 at the line corresponding to the end of the third message.

On racking-up the third and fourth messages from the window into the screen buffer store 2—the third message is automatically deleted—as is indicated by the delete flag D being ejected from the flag buffer 3 and the moving of the fourth message to a position adjacent to the second message. This situation is shown in FIG. 1(8).

If now further messages (i.e. text A, text B, text C etc.) are fed into the screen buffer store 1 the fourth message will be progressively racked-up from the display area 2 into the buffer store. Since it is required to retain or keep the fourth message a keep flag will be ejected from the flag buffer 3 when the last line of the fourth message leaves the display area. This situation is indicated in FIG. 1(9).

FIG. 1(10) illustrates the situation in which further messages text A, text B and text C have been entered and in which text A and text B are being kept. Of these texts the text B is part in the buffer store and part in the display area, is to be discarded (this condition is illustrated by the D in the flag buffer, and the current text (i.e. text C) is still being fed into the display 2. As soon as, but not before, the message, i.e. text B, to be discarded clears the display 2 it will be discarded—as shown by the buffer flag.

Figure 2:
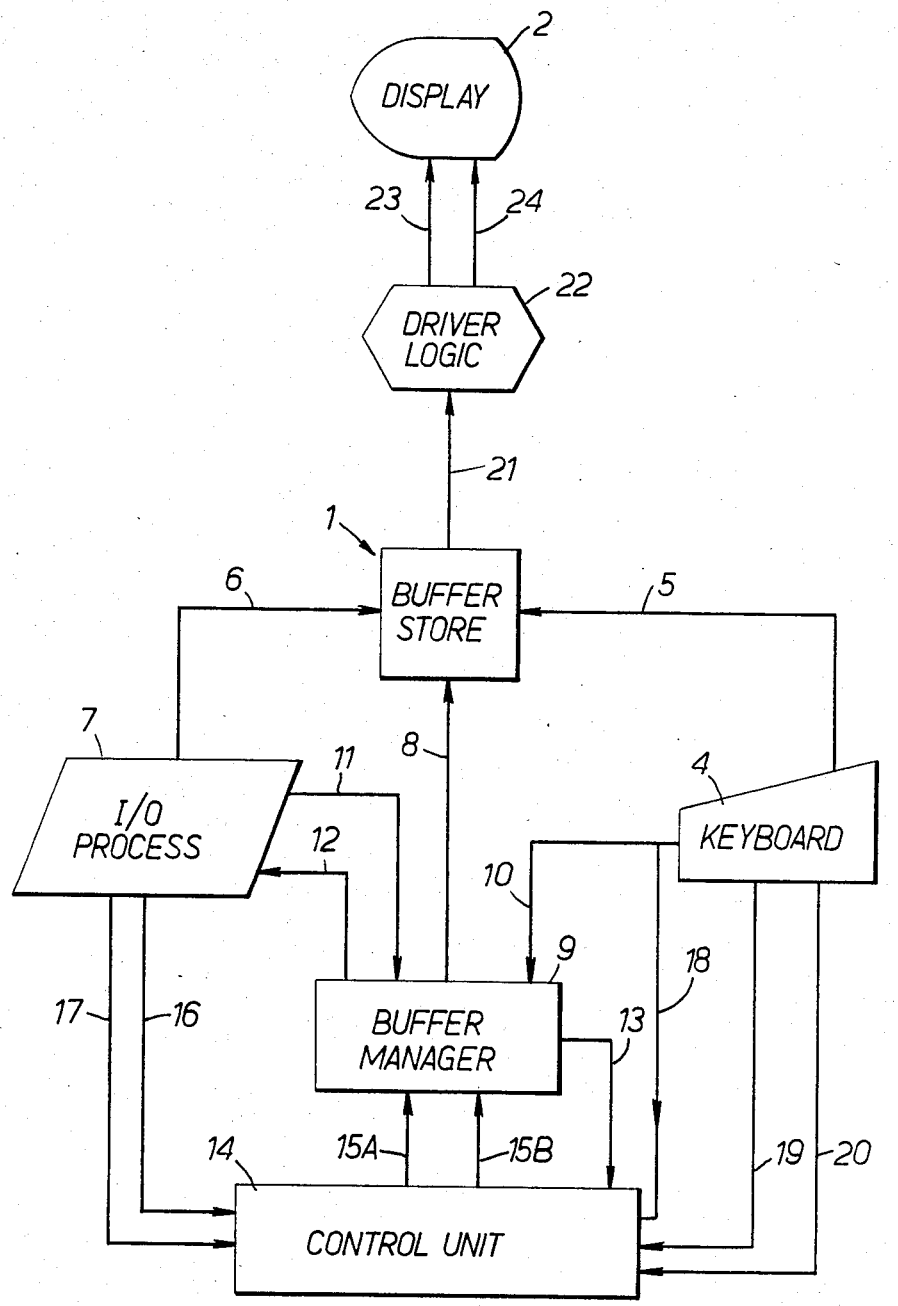
FIG. 2 is a schematic block diagram of a control system for a hand holdable terminal.

Referring now to FIG. 2 this is a schematic block diagram of an embodiment of a system for effecting the data entry, retention and deletion discussed in relation to FIGS. 1(1) to 1(10).

In the figure the screen buffer store 1 of the hand held interactive terminal unit is connected to receive input data from a keyboard unit 4 by way of a data line 5. The buffer store 1 also receives data by way of a data line 6 from an input/output process unit 7.

The input buffer also receives by way of an input line 8, control and address signals from a buffer manager unit 9.

This buffer manager unit 9 receives and produces a number of inputs and outputs as follows: A manual input request signal by way of a signal line 10 from the keyboard unit 4; a command input request signal by way of signal line 9 from the input/output process unit 7; a command output signal for the unit 7 by way of the signal line 12; signals related to the control of the position of a cursor signal and the racking-up of the display of the hand holdable terminal unit, these signals being fed by way of a signal line 13 to a control unit 14; and by way of a signal line 15, signals indicative of a data discard or data keep or retention.

The control unit 14 is connected to receive control signals on lines 16,17 respectively relating to a keep data code, and a start of message (SOM) signal.

In addition, the control unit 12 is connected to receive, by way of signal lines 18,19 and 20 respectively, output from the keyboard unit 4, a signal illustrative of a message keep requirement and a signal illustrative of a message send requirement.

The buffer store 1 communicates by way of a data line 21 with driver logic arrangements 22 which in turn connect by way of a synchronising signal line 23 and a data line 24 with the display window 2.

Figure 3:
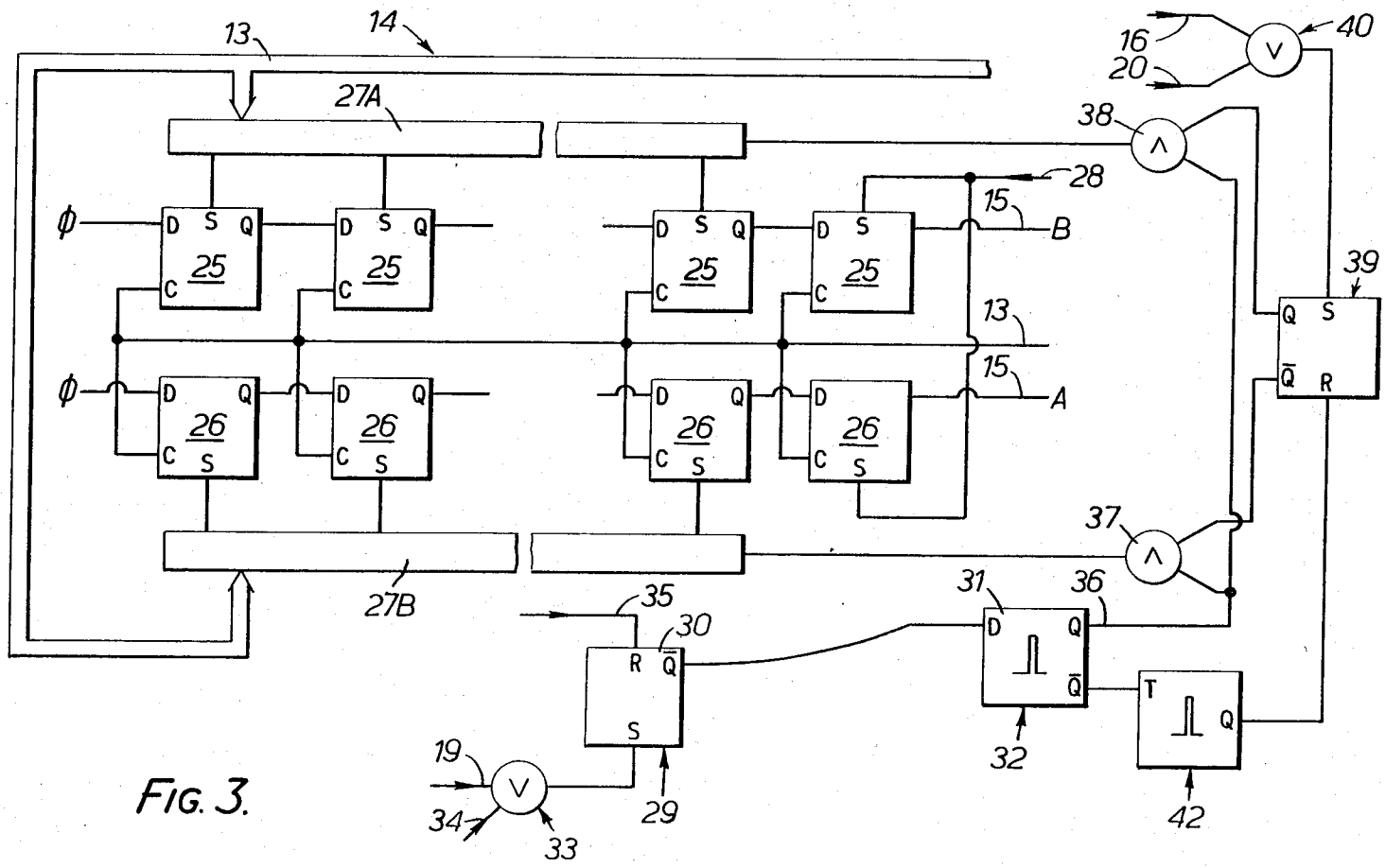
FIG. 3 schematically illustrates in greater detail a part of the control system of FIG. 2.

Referring now to FIG. 3 this illustrates an embodiment of the control unit 14, the unit 14 includes a register arrangement comprising two shift registers 25, 26 comprising in the example shown in the figure of D-type bistables. The clear inputs C of all of the bistables connect with a rack-up command signal line 13 (FIG. 2). The normal output Q of each of the bistables 25 connects with the data input D of the next succeeding bistable 25 whilst the normal output of the last bistable 25 of the series is used to provide the keep command signal on the line 15B (FIG. 2).

In the case of the bistables 26 of the second series the normal outputs Q are used to provide at the end of the series a discard command signal on the line 15A (FIG. 2). The cursor position control signals related to $2^n$ visable lines, and which appear on the line 13 are connectable to the set (reset) inputs (S) of the bistables 25 and 26 by way of the signal decoding arrangements 27A, 27B.

The bistables 25,26 at the ends of the respective series have their (S) inputs connected to a signal line 28 which constitutes a so-called 'handshake' with the buffer manager unit 9.

The control unit additionally includes a bistable 29, whose inverse output 30 connects with the data input 31 of a further bistable 32.

The send key output line 19 (FIG. 2) connects to one input of an OR gate 33 whose output connects with the set input of bistable 29. An end of message (EOM) signal line 34 (FIG. 3) connecting with the input/output unit 7 (FIG. 2) connects with a second input of the gate 33.

A signal line 35 connecting with the reset input of the bistable 29 connects with any graphics keys that may be provided on the keyboard unit 4. The normal output 36 of the bistable 32 connects with a first input of two OR gates 37,38, whose outputs respectively connect to the N way decoder units 27A, 27B.

The normal and inverse outputs of a further bistable 39 respectively connect with further inputs of the OR gate 38 and 37.

The keep decode line 16 (FIG. 2) is connected to a first input of an OR gate 40 whose output connects with the set input of the bistable 39 which holds the keep request until the end of the message. The keep key line 20 (FIG. 2) connects with a second input to the OR gate 40. The inverse output of the bistable 32 connects with the data input of a bistable 42 whose output connects with the reset input of the bistable 39.

I claim:

1. A method of handling data in a data terminal having a display area in which only a limited number of data lines can be displayed including the steps of:

entering data lines consecutively into the terminal until said limited number of data lines are displayed in the display area;

shifting the displayed data lines relative to the display area to remove data lines sequentially from the display area to thereby make available space for further data lines to be displayed;

selectively storing indicator flags in response to operator input signals which select particular data lines, wherein said indicator flags indicate whether the data lines, on removal from the display area, are to be retained; and, as the data lines are removed sequentially from the display area, retaining in a buffer store, having a capacity to store a greater number of lines of data than said limited number, each data line being indicated for retention.

2. A data terminal having a display area in which only a limited number of data lines can be displayed including:

a buffer store having a capacity to store a greater number of data lines than said limited number;

means for entering data lines consecutively into the terminal until said limited number of data lines are displayed in the display area;

means for shifting the displayed data lines relative to the display area to remove data lines sequentially from the display area to thereby make available space for further data lines to be displayed;

means for selectively storing indicator flags in response to operator input signals which select particular data lines, wherein said indicator flags indicate whether the datalines, on removal from the display area, are to be retained; and means operative in response to said indicator flags to retain in the buffer store each data line being indicated for retention as it is removed from the display area.

3. A data terminal as claimed in claim 2, including means adjacent the display area for providing a visual indication of whether the displayed data lines are to be retained or discarded.

4. A data terminal as claimed in claim 3, in which the terminal is a hand-held device.

* * * * *